United States Patent [19]

Marconnet

[11] Patent Number: 4,738,539

[45] Date of Patent: Apr. 19, 1988

[54] PROCESS AND DEVICE FOR FABRICATING BITUMINOUS COATED PRODUCTS FROM AGGREGATES ENCLOSING A LARGE QUANTITY OF FINES

[75] Inventor: Guy Marconnet, St Martin La Plaine, France

[73] Assignee: Ermont S. A., Lorette, France

[21] Appl. No.: 866,672

[22] Filed: May 27, 1986

[30] Foreign Application Priority Data

May 24, 1985 [FR] France ..... 85 07907

[51] Int. Cl.[4] ..... B28C 5/06; B28C 5/46

[52] U.S. Cl. ..... 366/4; 366/25

[58] Field of Search ..... 366/4, 22, 23, 24, 25, 366/57, 58, 59, 225, 228, 229, 144, 147

[56] References Cited

U.S. PATENT DOCUMENTS

| | | | |
|---|---|---|---|
| 4,089,508 | 5/1978 | Anderson | 366/25 |
| 4,095,285 | 6/1978 | Malbrunot | 366/23 |
| 4,103,350 | 7/1978 | Brock et al. | 366/22 |
| 4,147,436 | 4/1979 | Garbelman | 366/25 |
| 4,211,490 | 7/1980 | Brock et al. | 366/25 |
| 4,300,837 | 11/1981 | Malbrunot | 366/25 |
| 4,318,620 | 3/1982 | Maupier et al. | 366/25 |

*Primary Examiner*—Harvey C. Hornsby
*Assistant Examiner*—C. Reinckens
*Attorney, Agent, or Firm*—Pollock, Vande Sande & Priddy

[57] ABSTRACT

Process and device for fabricating bituminous coated products from aggregates enclosing a large quantity of fines, using a drying-mixing drum having a case (1) provided internally with fins of which some effect a complete raising of the aggregates in a drying zone (7, 8). Liquid bitumen is incorporated in the aggregates at the end of the drying zone (7, 8) with a raising of the aggregates. The hot mixing of the aggregates and the bitumen is effected in a zone (9) where the aggregates remain in contact with the wall of the drum. The excess fines in the hot gases at the outlet (3) of the drum are recovered. The process is also applicable in the use of recycled materials for producing the coated products.

14 Claims, 3 Drawing Sheets

F
3
9
17
V
V
1
X
D
8
IV
IV
20
22
27
7
VII
VII
III
III
6
II
II
5
2

32
1
31
30
33
35
17
40
36
39
37
38

PROCESS AND DEVICE FOR FABRICATING BITUMINOUS COATED PRODUCTS FROM AGGREGATES ENCLOSING A LARGE QUANTITY OF FINES

FIELD OF THE INVENTION

The invention relates to a process and a device for fabricating bituminous coated products in a drying-mixing drum from aggregates enclosing an excess amount of fines relative to the quantity required in the coated products.

BACKGROUND OF THE INVENTION

It is well known to carry out the fabrication in the hot state of bituminous coated products from aggregates and molten bitumen in a drying-mixing drum of cylindrical shape mounted for rotation about its axis which is slightly inclined to the horizontal plane so as to permit the circulation of the products in the drum.

The aggregates are continuously introduced through one end of the drum by which the flame of a burner penetrates, so that the drum is traversed by the aggregates and the hot gases circulating in the same direction. The blades disposed inside the drum raise the aggregates and then allow them to fall so that they occupy practically the whole of the transverse section of a drum in at least a part of its length. The molten bitumen is introduced into the drum in such manner as to be mixed with the aggregates, the drum ensuring the drying of the aggregates and their coating by the bitumen. There are recovered at the outlet of the drum coated products ready for use and hot gases which have passed through the drum.

The bituminous coated products must contain, in addition to the aggregates and the bitumen, a certain proportion of fines, i.e., materials having a particle size less than 80 microns. If the starting aggregates include a small amount of fines, it may be necessary to add them as independent constituents at the entrance of the drum. Further, during the drying of the aggregates, the hot gases circulating in the drum have a tendency to separate the fines from the aggregates and to entrain them in the direction of the outlet of the drum where these fines are found in the hot gases escaping in the chimney. It is therefore necessary to provide in the coating installations filters for trapping the fines before allowing the gases recovered in the drum to escape through the chimney of the coating station. The fines recovered by the filters may be re-introduced into the drum so as to maintain the proportion of fines in the coated products at the required value.

Processes for fabricating coated products have been proposed in which the bitumen is introduced onto the aggregates while the latter still enclose practically all their initial humidity. The subsequent drying of the aggregates takes place during the mixing of the aggregates and bitumen which are exposed to the hot gases by raising them in the section of the drum. In such processes, thereare avoided the separation of the fines and their entrainment by the hot gases, these powdered elements being fixed to the aggregates, first by the remaining humidity and then by the bitumen.

There has also been proposed a device described in French Patent Application No. 2,327,048, filed Oct. 8, 1975, which permits substantially complete drying of the aggregates prior to the introduction of the bitumen while avoiding the emission of dust in the gases rejected at the outlet of the drum. For this purpose, the prior drying is effected in a zone of the drum where there is constituted a very dense curtain of materials throughout the section of the drum. The bitumen is introduced just behind the curtain, the mixing being then effected by the rise and fall of the materials throughout the section of the drum. The materials coated with bitumen occupying the whole of the section of the drum enable the fines entrained by the hot gases to be trapped in the drying zone. Thus, there are found at the outlet of the drum gases enclosing a small proportion of fines, and it is possible to guarantee a minimum content of fines in the coated product.

However, in some cases, the initial content of fines of the aggregates is extremely high, and this content exceeds the desired final content in the coated products.

The processes and devices of the prior art described hereinbefore do not permit a reduction in the content of fines of the aggregates so as to maintain the optimum composition of the coated products.

Processes and devices are known which permit reutilizing the coated products recovered on repaired roads after crushing. Such devices may comprise a ring for introducing recycled materials obtained by crushing or milling in the vicinity of the central part of the drum. It has been proposed to extract the excess fines in the region of the recycling ring by removal of a part of the circulating gases. Such a process, however, has the drawback of reducing the yield of the installation and preventing its recycling operation when the device for extracting the gases in the recycling ring is put into operation.

SUMMARY OF THE INVENTION

An object of the invention is therefore to provide a process for fabricating bituminous coated products in a drying-mixing drum from aggregates enclosing an excess quantity of fines relative to the quantity required in the coated products, the aggregates being introduced continuously at one end of the drum by which the flame of a burner penetrates and then transported to the interior of the drum whose axis is slightly inclined relative to the horizontal, so as to be put into contact with the hot gases of the burner passing through the drum in the same direction as the aggregates and finally mixed with a liquid bituminous substance and stirred so as to cause their coating with said substance, the aggregates being raised and allowed to fall in the drum so as to occupy a large part of its cross-section during a part of their travel inside the drum corresponding to a aggregate drying zone, this process permitting the easy obtainment of an optimum final content of fines in the aggregates.

For this purpose:

1. the liquid bituminous substance is incorporated into the aggregates at the end of the drying zone by raising the aggregates in such manner that the excess fines which are separated from the aggregates during their contact with the hot gases remain in suspension in these hot gases circulating in the drum;

2. the hot mixing of the aggregates and the bituminous substance is effected without raising the aggregates in the drum, in contact with the inner wall of the latter and;

3. the hot gases are captured at the outlet of the drum so as to entrain out of the drum the excess fines.

The invention also relates to a device for permitting the fabrication of bituminous coated products from aggregates enclosing a large quantity of fines.

BRIEF DESCRIPTION OF THE DRAWINGS

In order that the invention may be more clearly understood, there will now be described, by way of example, two embodiments, of a device according to the invention, for fabrication of coated products from new materials and for fabrication of aggregates partly from recycled materials.

DESCRIPTION OF PREFERRED EMBODIMENTS

Figure 1:
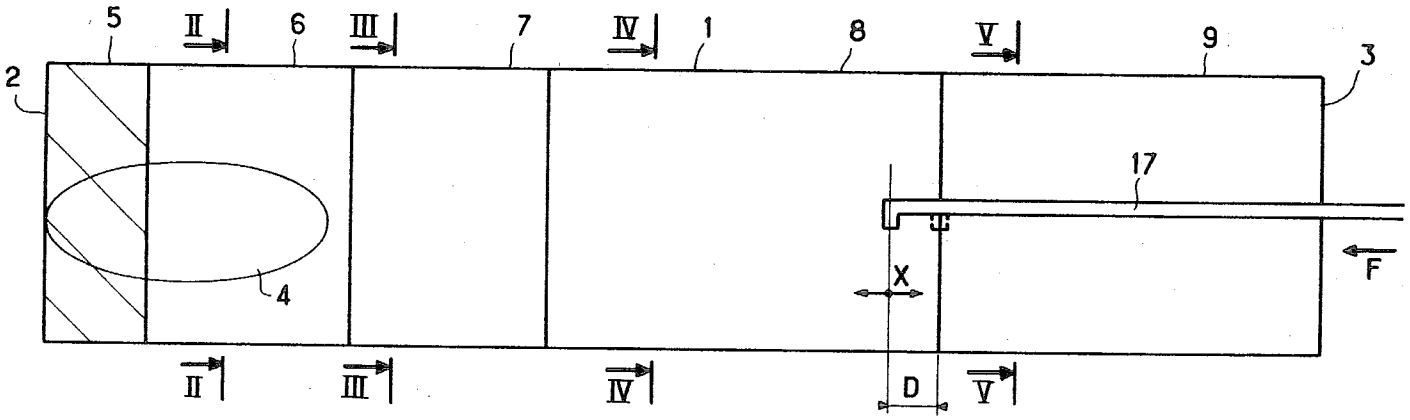
FIG. 1 is a diagrammatic longitudinal sectional view of a drying-mixing drum according to the invention for fabricating bituminous coated products from new materials.

FIG. 1 shows a drying-mixing drum comprising a cylindrical case 1 of great length having a longitudinal axis extending in a nearly horizontal direction. This drum is mounted for rotation about its axis by devices (not shown), and this axis is slightly inclined relative to the horizontal so that the inlet end 2 of the drum is at a height slightly greater than the outlet end 3. The flame 4 of a burner (not shown) enters the drum through the entrance end 2, through which the aggregates also enter the drum. These aggregates are constituted by a material having a large particle size, such as stones and/or sand enclosing a relative large proportion of fines having a particle size of less than 80 microns, this proportion being for example higher than 8%, i.e., higher than the maximum proportion of fines usually allowed for obtaining a coated product of good quality.

The drum comprises successive zones 5, 6, 7, 8 and 9 which are distiguished from each other by the shape of blades provided on the surface of the drum on the length of the corresponding zones.

Figure 2:
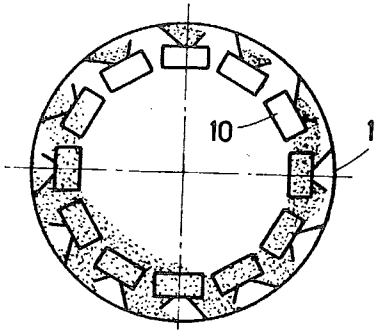
FIGS. 2, 3, 4 and 5 are sectional views taken on lines II—II, III—III, IV—IV and V—V of FIG. 1 or FIG. 6, respectively.
Figure 3:
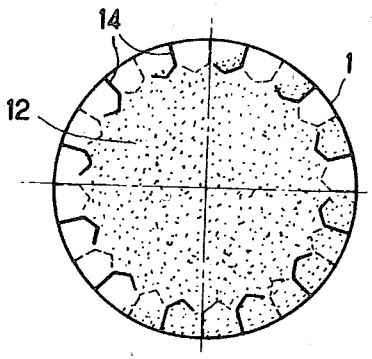
Figure 4:
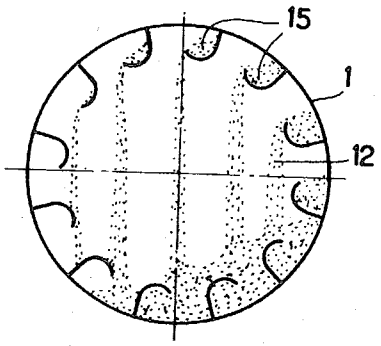
Figure 5:
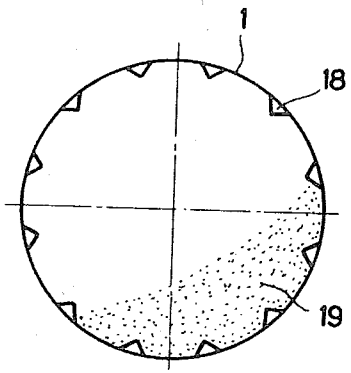

In the entrance zone 5, the inner surface of the drum is provided with fins of helical shape which ensure the rapid introduction of the aggregates into the drum so that these aggregates remain in contact with the inner wall of the case 1 of the drum. As can be seen in FIG. 2, in the zone 6, the inner surface of the drum is provided with screen blades 10 which transport the material from the periphery of the drum and protect it from the flame 4. Such screen blades are described in French Patent Application No. 80 00570 of Jan. 11, 1980. The aggregates 12 are thus protected in the entrance zones 5 and 6 against a direct action of the flame 4 and undergo only a limited pre-heating. The flame is developed in the free central zone of the drum whose case 1 is protected by the aggregates 12 retained by the screen blades 10. The use of screen blades also avoids the bursting of the aggregates by direct contact with the flame, and consequently the formation of fines in addition to those introduced with the aggregates.

In the zone 7, the inner surface of the case 1 is provided with a plurality of sets of blades 14 whose cross-section is in the shape of hooks. These hook blades 14 raise the aggregates 12 up to the highest point of the drum and allow them to fall back throughout the cross-section of the drum so as to constitute an extremely dense curtain of aggregates stopping the radiation of the flame and permitting intense drying of the aggregates 12.

In the zone 8, the case 1 of the drum is provided with blades 15 of channel shape placed farther apart than the hook blades 14 and permitting the pouring of the practically dry aggregates 12 onto a large part of the section of the drum. The aggregates 12 are thus in contact with the hot gases circulating in the drum between the entrance side 2 and the outlet side 3, so that these gases entrain the fines brought in by the aggregates 12. During the drying of the aggregates, the fines which are no longer connected by the humidity of the aggregates can become detached from the latter, so that they are entrained by the hot gases.

Disposed at the end of the zone 8 is the end of a pipe 17 for introducing liquid bitumen which permits spraying the bitumen onto the aggregates circulating in the drum.

In the zone 9 which is the mixing zone of the drum, the case 1 is provided with L-section members 18 of small height which stir the aggregates mixed with the bitumen in contact with the inner surface of the case 1 in the lower part of the drum. The aggregates coated with bitumen 12 are not raised in the section of the drum, so that the hot gases charged with fines do not come into contact with these coated aggregates. The fines are therefore not trapped and are found in the hot bases leaving the drum which are sent to the dust removing station installation so as to be separated out.

By adjusting the position of the end of the pipe 17 (displacement x in FIG. 1), i.e., the point of introduction of the bitumen with respect to the outlet of the zone 8, a regulation of the quantity of extracted fines and therefore the quantity of fines remaining in the coated products can easily be obtained.

Indeed, if the bitumen pipe opens into the drum before the end of the zone 8, there is a zone of length D in which the aggregates mixed with the bitumen are raised throughout the section of the drum and constitute a curtain of materials covered with liquid bitumen which the gases containing the fines travel through before entering the zone 9. This curtain formed of materials having a high adhesivity retains a part of the fines in suspension in the gases and thus constitutes a filter for the hot gases. The quantity of fines retained depends on the length D, and it is possible to adjust the position of the point of introduction of the bitumen so as to maintain in the hot gases exactly the excess quantity of fines. These excess fines are then entrained by the gases through the outlet of the drum and retained in the dust-removing means of the coating station. It is also possible to dispose the pipe 17 just at the outlet of the zone 8, reducing the length D of the hot gas filtering zone to zero. In this way, a large quantity of fines is entrained with the hot gases to the outlet of the drum.

The length of the zone 9 is determined in such manner as to obtain sufficient mixing or stirring and consequently a coating of good quality.

Therefore, by means of the invention there is obtained a regulation of the content of fines in the coated product, with, however, an increase in the total length of the drum due to the presence of a mixing zone, without raising the materials in the drum.

Figure 6:
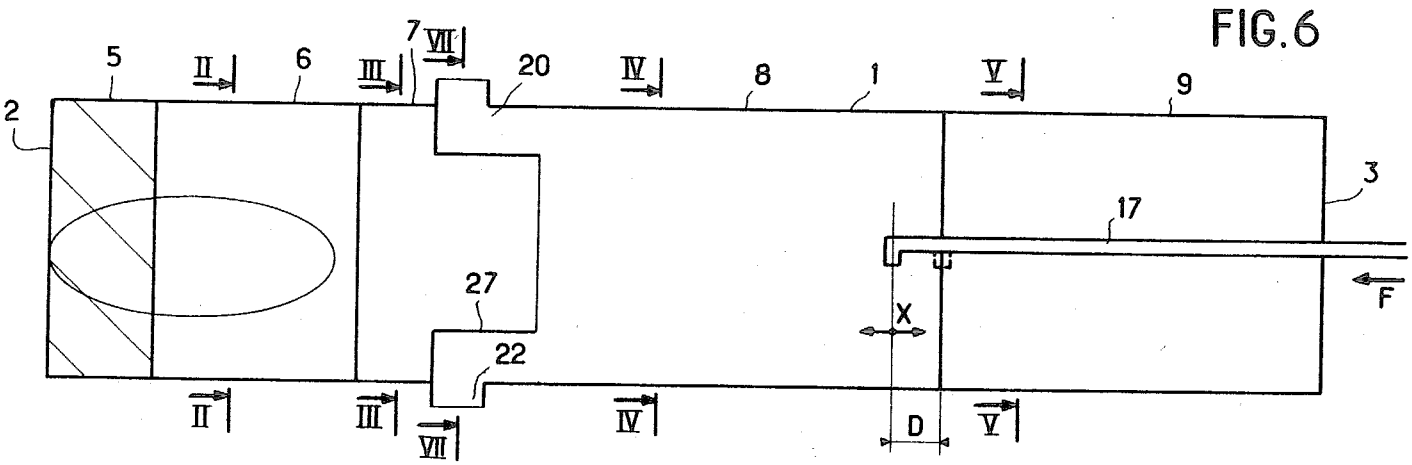
FIG. 6 is a diagrammatic longitudinal sectional view of a drying-mixing drum comprising a recycled material introducing ring.

FIG. 6 shows a drying-mixing drum which is modified so as to permit the introduction and treatment of recycled materials. The equivalent zones and elements in FIGS. 1 and 6 have been designated by the same reference characters.

Figure 7:
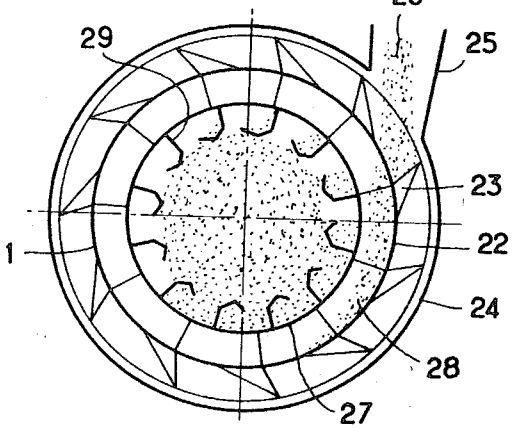
FIG. 7 is a sectional view taken on line VII—VII of FIG. 6.

The sole difference between the drums illustrated in FIGS. 1 and 6 relates to the design of the zone 20 interposed between the zones 7 and 8 of the drum in the region of the recycling ring shown in FIG. 7.

In this intermediate recycled product introduction zone 20 which was described in the French Patent Application No. 80 00570, the case 1 of the drum has openings 22 separated by introduction channels 23 having inclined surfaces. The recycling ring 24 surrounding the case 1 of the drum in the zone 20 includes a hopper 25 for introducing the recycled materials 26. Fixed inside the case 1 is a second coaxial case 27 of smaller diameter on which helical fins 28 are secured externally and hooking blades 29 internally. The recycled material 26 enters through the openings 22 in the case 1 where these materials are received by the inner case 27 and the helical fins 28 which urge this material into the zone 8 of the drum.

The recycled materials are then dried and heated in the zone 8 by direct contact with the hot gases circulating in the drum.

At the outlet of the zone 8, the addition of heat to the recycled materials is such that the bitumen contained in these materials starts to melt.

Simultaneously with the introduction of the recycled materials in the drum, there is effected in the manner already described an introduction of new aggregates through the inlet end 2 of the drum. The new materials and the recycled materials are thus mixed and complementary bitumen is introduced through the pipe 17 whose spraying end is disposed in the vicinity of the end of the zone 8.

As before, the fines entrained by the gases are not stopped by the materials in the mixing or stirring zone 9, the mixing occurring without raising the materials in contact with the inner surface of the case 1.

In the zone 8, the recycled materials raised in the drum do not permit significant trapping of the fines entrained by the gases since the melting of the bitumen contained in the recycled materials only really begins at the outlet of the zone 8.

As before, it is thus possible to regulate very easily the content of fines in the coated products, these fines coming both from the new starting aggregate and the recycled materials.

Figure 8:
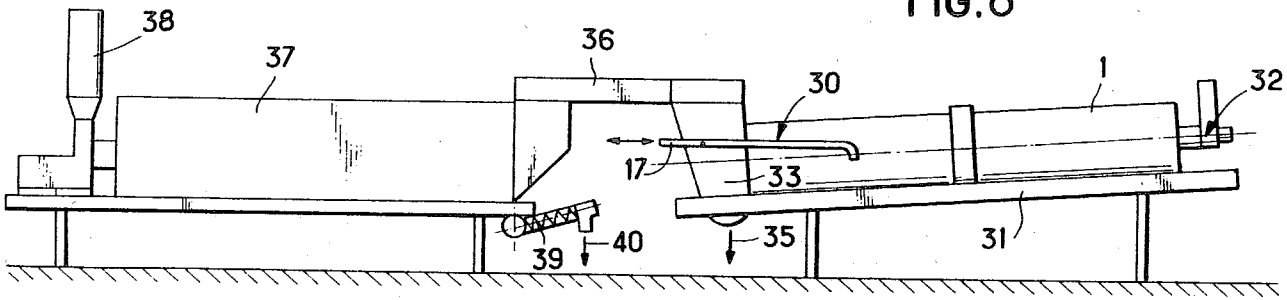
FIG. 8 is a diagrammatic elevational view of a coating station which limits the content of fines of the coated products.

In FIG. 8, there can be seen a coating station which includes a drum 30 whose case 1 is inclined relative to the horizontal plane fixed on the platform 31. A burner 32 enters the inlet end of the drum and a discharging chamber 33 receives at the outlet of the drum the prepared coated products and communicates in its upper part with a duct 36 which passes the hot gases including the fines into a dust removal installation 37. The latter includes either multi-cyclones and washers or sleeve filters. The purified gases are expelled to the atmosphere through a chimney 38 and the recovered fines are discharged (arrow 40) by a screw handling device 39.

The process and the device according to the invention have as their main advantages to permit a decrease in the content of fines of an aggregate and to achieve the coating of this aggregate in the same device by means of a simple means for regulating the residual content of fines. This regulating means may advantageously be constituted by a bitumen introduction nozzle opening into the drum at an adjustable location in the vicinity of the end of the drying zone with a raising of the materials in the drum.

The device may also be designed for treating recycled materials obtained by milling or crushing bituminous road surfaces and containing a relatively large quantity of fines produced when milling or crushing. In this case also, the content of fines in the coated products coming either from recycled materials or from new aggregates introduced at the inlet of the drum may be lowered by the process according to the invention, by the entrainment of the excess fines in the hot gases travelling through the drum. In this case, the extraction of the fines with the gases at the outlet of the drum and not in the region of the recycling ring, permits effecting simultaneously the removal of the fines and the recycling.

The process and the device according to the invention therefore permit the production of bituminous products from aggregates enclosing large proportions of fines.

It is possible to conceive of drying and mixing drums of a type different from those described for carrying out the process according to the invention. The material raising blades in the various zones of these drums may have shapes different from those described and illustrated. The mixing or stirring devices of the end zone of the drum may be of any shape and size and, in some cases, it may even be possible to conceive of a mixing zone where the inner surface of the case of the drum which does not include a mixing device is completely smooth.

The bitumen introduction device may be a device different from a pipe whose outlet end has an adjustable position in the vicinity of the end of the drying zone with raising of the materials. This device may be fixed and disposed exactly at the outlet of the drying zone with raising of the material, i.e., at the inlet of the mixing zone without raising. This arrangement will normally be adopted in the case of extremely dusty aggregates.

The process and device according to the invention are applicable to the hot production of any bituminous coated product from aggregates including large quantities of fines, with or without introduction of recycled materials.

What is claimed is:

1. In a process for fabricating bituminous coated products in a drying-mixing drum having an inlet and an outlet from aggregates enclosing an excess quantity of fines relative to the quantity required in the coated products, comprising continuously introducing the aggregates into the drum at one end of the drum by which end the flame of a burner penetrates, then conveying inside the drum, whose axis is slightly inclined to the horizontal, so as to put the aggregates in contact with hot gases of the burner which travel through the drum in the same direction as the aggregates and finally mixing the aggregates with a liquid bituminous substance and stirring so as to coat the aggregates with said substance, causing the aggregates to rise and to fall back within the drum so as to occupy a large part of the cross-section of the drum, during a part of the travel of the aggregates inside the drum corresponding to a zone of the drum for drying the aggregates, the improvement comprising:

incorporating said liquid bituminous substance into the aggregates at the end of said drying zone by raising the aggregates in such manner that the excess fines which are separated from the aggregates during their contact with said hot gases remain in suspension in said hot gases circulating in the drum;

hot mixing the aggregates and said bituminous substance in a mixing zone of the drum operative without raising the aggregates in the drum, in contact with an inner wall of the drum;

collecting the hot gases at the outlet of the drum so as to entrain the excess fines out of the drum.

2. A process for fabricating coated products according to claim 1, comprising incorporating said liquid bituminous substance into the aggregates in a region of the drum which is adjustable along the length of the drum in the vicinity of the end of said zone for drying the aggregates by raising of the aggregates.

3. A process for fabricating coated products according to claim 1, comprising incorporating said liquid bituminous substance into the aggregates at the outlet of said zone for drying the aggregates by a raising thereof, i.e., at the entrance of said mixing zone without raising the aggregates.

4. A process for fabricating coated products according to claim 1, further comprising incorporating, in addition in the aggregates, a recycled bituminous material containing excess fines, in said zone for drying by raising the aggregates.

5. A process for fabricating coated products according to claim 4, wherein said recycled bituminous material is obtained by milling.

6. A process for fabricating coated products according to claim 4, wherein said recycled bituminous material is obtained by crushing.

7. A device for fabricating bituminous coated products comprising a dry-mixing drum having a longitudinal axis, a case, an inlet at one end of the drum and an outlet at an opposite end of the drum, a burner combined with the drum so as to produce a flame which enters the drum through said inlet, said inlet being adapted to also receive aggregates, the drum having a group of successive zones between the inlet and the outlet, means for recovering coated products and hot gases which have travelled through the drum in communication with said outlet, the different successive zones comprising on an inner surface of the case of the drum fins which are different from one zone to the other, at least one of the zones having fins which ensure complete raising of the treated material and falling back of the material throughout the section of the drum, the device further comprising means for introducing a bituminous substance adjacent an outlet end of said zone ensuring the complete raising of the aggregates, and a mixing zone which follows said zone for drying with raising of the aggregates relative to the direction of travel of the aggregates through the drum and comprises mixing means on an inner surface of said case of the drum which ensure a mixing and stirring without raising the aggregates and the bituminous substance.

8. A device for fabricating bituminous coated products according to claim 7, wherein the fins in said mixing zone are constituted by L-section elements of small height in the radial direction of the case of the drum which are slightly inclined relative to said axis of the drum.

9. A device according to claim 7, wherein said means for introducing the bituminous substance comprises a pipe having an outlet end which has an adjustable position axially of the drum.

10. A device according to claim 8, wherein said means for introducing the bituminous substance comprises a pipe having an outlet end which has an adjustable position axially of the drum.

11. A device according to claim 7, comprising a zone for introducing recycled materials comprising a recycling ring, and, disposed inside said ring in succession radially of said axis, said case of the drum, which case defines openings for introducing the recycled materials, and a second case which is located solely in the length of said zone for introducing recycled materials and is connected to said case of the drum, helical fins carried on an outer surface of said second case and raising fins carried on an inner surface of said second case.

12. A device according to claim 8, comprising a zone for introducing recycled materials comprising a recycling ring, and, disposed inside said ring in succession radially of said axis, said case of the drum, which case defines openings for introducing the recycled materials, and a second case which is located solely in the length of said zone for introducing recycled materials and is connected to said case of the drum, helical fins carried on an outer surface of said second case and raising fins carried on an inner surface of said second case.

13. A device according to claim 9, comprising a zone for introducing recycled materials comprising a recycling ring, and, disposed inside said ring in succession radially of said axis, said case of the drum, which case defines openings for introducing the recycled materials, and a second case which is located solely in the length of said zone for introducing recycled materials and is connected to said case of the drum, helical fins carried on an outer surface of said second case and raising fins carried on an inner surface of said second case.

14. A device according to claim 10, comprising a zone for introducing recycled materials comprising a recycling ring, and, disposed inside said ring in succession radially of said axis, said case of the drum, which case defines openings for introducing the recycled materials, and a second case which is located solely in the length of said zone for introducing recycled materials and is connected to said case of the drum, helical fins carried on an outer surface of said second case and raising fins carried on an inner surface of said second case.

* * * * *